United States Patent [19]

Ishikawa

[11] Patent Number: 4,816,365

[45] Date of Patent: Mar. 28, 1989

[54] ELECTROSTATIC RECORDING DRY TONER

[75] Inventor: Katsukiyo Ishikawa, Kyoto, Japan

[73] Assignee: Nippon Paint Co., Ltd., Osaka, Japan

[21] Appl. No.: 867,672

[22] Filed: May 28, 1986

[30] Foreign Application Priority Data

May 29, 1985 [JP] Japan ..... 60-116139

[51] Int. Cl.[4] ..... G03G 9/08

[52] U.S. Cl. ..... 430/111

[58] Field of Search ..... 430/108, 109, 111

[56] References Cited

U.S. PATENT DOCUMENTS 4,055,684 10/1977 Baltazzi et al. ..... 430/111

4,264,698 4/1981 Takayama et al. ..... 430/111

4,269,920 5/1981 Wada et al. ..... 430/111

*Primary Examiner*—John L. Goodrow

*Attorney, Agent, or Firm*—Wenderoth, Lind & Ponack

[57] ABSTRACT

An electrostatic recording dry toner made up of a uniform mixture of (A) precolored resin particles consisting essentially of thermoplastic resin and colorant and having an average size of 5 to 15μ, (B) spherical resin particles having an average size of 0.01 to 2.00μ and having on their surfaces a charge controlling agent or cationic or anionic resin, and (C) silica particles having an average size of 1μ or less, is provided. The present dry toner can produce copies with high picture qualities at a higher transfer ratio even in a long run continuous reproduction.

1 Claim, No Drawings

ELECTROSTATIC RECORDING DRY TONER

FIELD OF THE INVENTION

The present invention relates to an electrostatic recording dry toner and more specifically it concerns an electrostatic recording dry toner capable of producing copies with high picture qualities in a higher transfer ratio even in a long run continuous reproduction.

BACKGROUND OF THE INVENTION

Heretofore proposed electrostatic recording dry toners have been prepared by the method wherein a colorant, a charge controlling agent and other optional additives as magnetic material are combined with a thermoplastic resin, thus obtained mixture is heat-melted and the cooled mass is pulverized and classified to obtain the toner particles of 5 to 15μ size.

However, since it is quite difficult to obtain a uniform dispersion of such charge controlling agent as nigrosine, oil black and other dyestuffs, a metal complex of an organic acid and the like in a molten resin, the thus formed toner particles always have the drawback of lacking in uniformity of the amount of charge controlling agent carried on the exposed surface thereof. It is, therefore, unavoidable that when charged, each toner particle acquires each different level of electrical charge, which inevitably causes the failure of exact development of charge pattern made on sensitized material, decrease in transfer ratio and considerable fluctuation in picture qualities at the time of long run continuous reproduction.

Also, since the charge controlling agent covered with the thermoplastic resin and remaining within the toner particle can fulfill only a decreased charge controlling function at the time of electrification, in order to get the toner capable of being electrified at the desired charge, it is essential that an excess amount of expensive charge controlling agent be included within the toner particles, which is economically undesirable.

The inventors, with the object of obviating the aforesaid drawbacks possessed by the heretofore known electrostatic recording dry toners, have continued studies and completed the invention.

SUMMARY OF THE INVENTION

A principal object of the present invention is, therefore, to provide an electrostatic recording dry toner which is excellent in powder characteristics and is also quite satisfactory with respect to picture quality, transfer ratio and long run continuous reproductivity. An additional object of the invention is to provide such dry toner in an economical way.

According to the present invention, the aforesaid objects can be fully attained by providing an electrostatic recording dry toner made up of a uniform mixture of (A) precolored resin particles consisting essentially of thermoplastic resin and colorant and having an average size of 5 to 15μ.

(B) spherical resin particles having on their surfaces a charge controlling agent or cationic or anionic resin, and having an average size of 0.01 to 2.00μ, and (C) silica particles having an average size of 1μ or less.

PREFERRED EMBODIMENTS OF THE INVENTION

The first component (A) of the present dry toner is the precolored resin particles consisting essentially of thermoplastic resin and colorant and having an average size of 5 to 15μ. Inclusion of charge controlling agent in the precolored resin particles is optional. Since there is no need of the charge controlling agent being included in these resin particles, or being uniformly distributed in them, preparation of such particles is very easy and simple. That is, these particles may be easily prepared by a conventional method, for example, by making a pre-mixture of colorant, thermoplastic resin and other optional additives (including a charge controlling agent) in a ball mill, Henschel mixer or the like, hot melt-kneading the mixture in such apparatus as biaxial extruder, Banbury mixer and the like, pulverizing the extruded product in a pulverizer such as a Jet mill and classifying the formed powders in a flash classifier to obtain the particles having the desired particle size. As the thermoplastic resin and colorant, any of the materials heretofore used in the preparation of electrostatic recording dry toners may be satisfactorily used.

The second component (B) of the present dry toner is the spherical resin particles having on their surfaces a charge controlling agent or cationic or anionic resin and having an average size of 0.01 to 2.00μ. Such particles may be advantageously prepared by the following methods. That is, one or more of polymerizable monomers are first polymerized by using a known emulsion or suspension polymerization technique. In the emulsion polymerization, the polymerizable monomers are dispersed and emulsified in water containing an emulsifier and the polymerization is carried out by adding a water soluble polymerization initiator, with or without using a protective colloid. In the suspension polymerization, the polymerizable monomers and hydrophobic polymerization initiator are suspended in water containing a protective colloid and the polymerization is carried out, with or without using an emulsifier . No particular technique is required for the said emulsion or suspension polymerization. In either method, a reaction mixture in which the polymer particles are dispersed or suspended in water medium is obtained.

Next, a coating of charge-controlling agent or cationic or anionic resin may be given as follows. In the case of cationic or anionic resin coating, the aforesaid reaction mixture is added with a cationic or anionic polymerizable monomer and is further polymerized. In this post polymerization, there is no need of adding an additional amount of polymerization initiator, protective colloid and/or emulsifier, and however, it is only a matter of choice, as will be easily understood.

The thus obtained suspension is filtered and the recovered residue is washed with water, dried, pulverized and classified to obtain the spherical resin particles having on their surfaces a coating of cationic or anionic resin and having the desired particle size. It is also possible to subject the aforesaid suspension directly to a spray drying and then to a classification to obtained the desired resin particles.

In the case of the spherical resin particles with a coating of charge controlling agent or cationic or anionic resin, they may be advantageously prepared as follows.

That is, the polymerizable monomers are first polymerized by using an emulsion polymerization or suspension polymerization technique and the polymer powders are obtained by a combination of known steps of filtration, washing, drying and pulverization. Thus obtained powders are then uniformly dispersed in a solution of charge controlling agent or cationic or anionic resin in a solvent in which the resin powders are insoluble, the solvent is then evaporated and the residue is again pulverized and classified.

The present spherical resin particles (B) may also be prepared by effecting emulsion polymerization or suspension polymerization using polymerizable monomers added with soluble charge controlling agent or anionic or cationic monomer which is compatible with said polymerizable monomers. However, since the charge controlling function relies on the surface composition of the spherical resin particles alone, preference is given to the former two methods. The charge controlling agent, cationic resin and anionic resin are a common type.

As the silica particles (C) having an average size of 1μ or less, any of the known silica materials may be satisfactorily used, but particular preference is given to the material of hydrophobic nature. Examples of preferred members are Aerosil R972 (trade mark, Degussa) and the like. The precolored resin particles (A) having an average size of 5 to 15μ, the spherical resin particles (B) having an average size of 0.01 to 2.00μ and having on their surfaces a charge controlling agent or cationic or anionic resin on the respective particle, and the silica particles (C) having an average size of 1μ or less are mixed together to give the present dry toner. The mixing ratio of said (A), (B) and (C) may vary in a considerable range with the average size of said precolored resin particles (A), the cationic or anionic degree of said (B) and the average size of said (C), and however, preferably it is selected in a range, in terms of weight ratio, of (A):(B):(C)=100:0.1–5.0:0.1–2.0. In this mixing, any of the known methods including flash mixing using a low pressure Jet mill fitted with an impact board at a gentle slope, mechanical mixing using a pin mill and the like may be satisfactorily used.

Thus obtained electrostatic recording dry toner of the invention is, differing from the heretofore known dry toners, characterized by having an excellent powder characteristics and showing a uniform charge distribution. Therefore, at the time of development, it is uniformly adsorbed on the charge pattern made on the sensitive material, thereby forming a sharp image on said material and at the time of transfer, a higher transfer ratio can be realized therewith.

Furthermore, at the time of long run continuous reproduction, there is the least spent toner and no remarkable change in picture quality even 100000 and more reproduction. Thus, the present toner has a long service life as compared with those of the heretofore known dry toners.

The invention shall be now more fully explained in the following Examples. Unless otherwise being stated, all parts and percentages are by weight.

EXAMPLE 1

85.0 parts of styrene resin (Picolastick D-150, trade mark, Hercules Co.), 8.0 parts of carbon black (Monarch 880, trade mark, Cabot Co.) and 7.0 parts of polypropylene wax (Viscol 550P, trade mark, Sanyo Kasei) were dry-mixed in a ball mill for 12 hours and the mixture was kneaded and extruded by a biaxial extruder (barrel temperature 125° C.). The extruded product was then crushed to the powders of less than 30 mesh-through in a pin mill, subjected to a micropulverization in a Jet mill and finally classified in a flash classifier to obtain the precolored resin particles (A) having an average size of 10μ, the amount of particles below 5μ being 1% or less and the amount of particles above 20μ being 1% or less.

In a separate reaction vessel fitted with a stirrer, a thermometer, a nitrogen gas inlet tube and a reflux condenser, were placed 100 parts of methyl methacrylate, 200 parts of deionized water, 0.3 part of potassium persulfate, 3 parts of polyoxyethylene nonyl phenol and 1 part of sodium lauryl sulfate, and the mixture was polymerized according to a conventional emulsion polymerization means, under nitrogen gas stream at 82° C. for 4 hours. Thereafter, while maintaining the same temperature, 10 parts of methacrylic acid were added and the polymerization was further effected for 1 hour. After completion of the reaction, the mixture was allowed to cool to obtain the spherical resin particles (B) having an average size of 0.05 to 0.08μ and bearing an anionic surface coating on the respective particle.

Using a Jet mill fitted with a ceramic impact board at 20° angle, 100 parts of said precolored resin particles (A), 1.5 parts of said spherical resin particles (B) and 0.5 part of hydrophobic silica particles (Aerosil R972, trade mark, Degussa) were flash-mixed to obtain an electrostatic recording dry toner. The characteristics of said toner are shown in Table 1.

EXAMPLE 2

83.8 parts of styrene resin (Picolastick D-150, trade mark, Hercules Co.), 7.8 parts of carbon black (Monarch 880, trade mark, Cabot Co.), 6.8 parts of polypropylene wax (Viscol 550P, trade mark, Sanyo Kasei) and 1.6 parts of negative charge controlling agent (Bontron S-31, trade mark, Orient Chemical) were dry-mixed in a ball mill for 12 hours and the mixture was kneaded and extruded by a biaxial extruder (barrel temperature 125° C.). Thereafter, the same procedures as stated in Example 1 were repeated to obtain precolored resin particles (A) having an average size of 11μ.

100 parts of said precolored resin particles (A), 1.5 parts of the spherical resin particles (B) obtained in Example 1, and 0.5 part of hydrophobic silica particles (Aerosil R972, trade mark, Degussa) were uniformly mixed as in Example 1 to obtain an electrostatic recording dry toner. The characteristics of said toner are shown in Table 1.

EXAMPLE 3

Repeating the same procedures as stated in Example 1 but using 80 parts of styrene resin (Picolastick D-150, trade mark, Hercules Co.), 13 parts of magnetite (KBC-100, trade mark, Kantoh Denka Co.) and 7 parts of polypropylene wax (Viscol 550P, trade mark, Sanyo Kasei), precolored resin particles (A) having an average size of 10μ, the amount of particles below 5μ being 1 wt% or less and the amount of particles above 20μ being 1 wt% or less, were prepared. Next, into a similar reaction vessel as used in Example 1, were placed 100 parts of styrene, 2 parts of divinyl benzene, 250 parts of deionized water, 0.3 part of potassium persulfate, 4 parts of polyoxyethylene nonyl phenol and 1 part of sodium lauryl sulfate, and the mixture was subjected to an emulsion polymerization under nitrogen gas stream at 80° C. for 5 hours. After completion of said reaction, the mixture was allowed to cool, filtered, washed with water, dried and pulverized to obtain the spherical gelated polystyrene particles having an average size of 0.05 to 0.1μ.

A mixed solution was then prepared by adding 5 parts of butyral resin (XYHL, trade mark, UCC) and 5 parts of cationic nigrosine dye (Bontron N-09, trade mark, Orient Chemical) into 200 parts of ethanol and to this solution, the aforesaid gelated polystyrene particles were uniformly dispersed. The dispersion was then fed to a vacuum flash evaporator to obtain the spherical resin particles (B) having a cationic surface coating on it. 100 parts of said precolored resin particles (A), 2 parts of said spherical resin particles (B) having on the surface of the respective particle a cationic coating, and 0.1 part of hydrophobic silica particles (Aerosil R972, trade mark, Degussa) were mixed well as in Example 1 to obtain an electrostatic recording dry toner. The characteristics of said toner are shown in Table 1.

EXAMPLE 4

Following the procedures of Example 1 but using 79.0 parts of styrene resin (Picolastick D-150), 12.5 parts of magnetite (KBC-100, trade mark, Kanto Denka), 6.8 parts of polypropylene wax (Viscol 550P), and 1.7 parts of positive charge controlling agent (Bontron N-09, trade mark, Orient Chemical), precolored resin particles (A) having an average size of 10μ, the amount of particles below 5μ being 1 wt% or less and the amount of particles above 20μ being 1 wt% or less, were obtained.

Next, 100 parts of said precolored resin particles (A), 2 parts of the spherical resin particles (B) of Example 3 and 0.1 part of hydrophobic silica particles (Aerosil R972) were uniformly mixed as in Example 1 to obtain an electrostatic recording dry toner. The characteristics of said toner are shown in Table 1.

TABLE 1

| | Characteristics of toners | | | | |
|---|---|---|---|---|---|
| Toner | Comp. Example | Example 1 | Example 2 | Example 3 | Example 4 |
| Size distribution | | | | | |
| average size | 10μ | 10μ | 11μ | 10μ | 10μ |
| amount of particles below 5μ | 0.7% | 0.4% | 0.4% | 0.7% | 0.5% |
| amount of particles above 20μ | 0.2% | 0.2% | 0.3% | 0.7% | 0.7% |
| Powder characteristics | | | | | |
| Reposing angle | 45° | 38° | 38° | 36° | 36° |
| Compression degree | 43% | 39% | 39% | 38% | 37% |
| Charge | | | | | |
| average charge | −26 μc/g | −28 μc/g | −29 μc/g | +20 μc/g | +20 μc/g |
| charge distribution | −15~−34 μc/g | −22~−32 μc/g | −21~−32 μc/g | +11~+26 μc/g | +10~+26 μc/g |
| Transfer ratio | 89% | 96% | 96% | 97% | 97% |
| Blocking temperature | 50° C. | 55° C. | 55° C. | 55° C. | 55° C. |
| Initial image qualities | | | | | |
| Image density | 1.5 | 1.6 | 1.6 | 1.6 | 1.6 |
| fogging | none | none | none | none | none |
| step reproduction | 6 steps | 8 steps | 8 steps | 8 steps | 8 steps |
| After tests in the long run* | | | | | |
| Reduction of image density | 53% | 6% | 6% | 8% | 8% |
| fogging | thorough fogging | none | none | none | none |
| Reduction of step reproduction | −2 steps | none | none | none | none |
| Reduction of charge | 30% | 3.5% | 3.6% | 4.5% | 4.4% |
| Reduction of transfer ratio | 15% | 3% | 3% | 4% | 4% |

*Long run tests were carried out by using PPC Copier FP-3000 (manufactured by Matsushita Elect. Co.) in Examples 1, 2 and Comparative Example and PPC Copier FP-1000 (manufactured by Matsushita Elect. Co.) in Example 3 and 4. In each test, 100,000 sheets of copies (A-4 size) were made and thereafter, the test results were evaluated.

The aforesaid test results clearly show that the present toners are far superior to the known toner in every respect of powder characteristics, transfer ratio, initial image qualities and long run test results.

What is claimed is:

1. An electrostatic recording dry toner made up of a uniform mixture of (A) precolored resin particles consisting essentially of thermoplastic resin and colorant and having an average size of 5 to 15μ.

(B) spherical resin particles having an average size of 0.01 to 2.00μ and having on the respective particle surface a coating layer of a charge controlling agent or cationic or anionic resin, and (C) silica particles having an average size of 1μ or less.

* * * * *